US009500452B1

(12) United States Patent
Donahoe et al.

(10) Patent No.: US 9,500,452 B1
(45) Date of Patent: Nov. 22, 2016

(54) APPARATUS, SYSTEM AND METHOD FOR ELECTRONIC ARCHERY DEVICE

(71) Applicant: Full Flight Technology, LLC, Cambridge, MA (US)

(72) Inventors: Robert V. Donahoe, Newton, MA (US); Paul Chandler Sabin, Needham, MA (US); Jason Evan Avis, Norwich, VT (US)

(73) Assignee: Full Flight Technology, LLC, Cambridge, MA (US)

( * ) Notice: Subject to any disclaimer, the term of this patent is extended or adjusted under 35 U.S.C. 154(b) by 0 days.

(21) Appl. No.: 13/757,749

(22) Filed: Feb. 2, 2013

Related U.S. Application Data

(60) Provisional application No. 61/594,631, filed on Feb. 3, 2012.

(51) Int. Cl.
*F42B 6/04* (2006.01)
*F42B 12/38* (2006.01)

(52) U.S. Cl.
CPC ..... *F42B 6/04* (2013.01); *F42B 12/385* (2013.01)

(58) Field of Classification Search
USPC ..... 473/570, 578, 583, 585, 586
See application file for complete search history.

(56) References Cited

U.S. PATENT DOCUMENTS 3,790,948 A 2/1974 Ratkovich
4,421,319 A 12/1983 Murphy
4,547,837 A 10/1985 Bennett
4,675,683 A 6/1987 Robinson et al.
4,694,555 A * 9/1987 Russell ..... H05K 7/1417 174/544
4,704,612 A 11/1987 Boy et al.
4,749,198 A 6/1988 Brailean
4,845,690 A 7/1989 Oehler
4,885,800 A 12/1989 Ragle
4,951,952 A 8/1990 Saddler
4,989,881 A 2/1991 Gamble
5,058,900 A 10/1991 Denen
5,094,463 A * 3/1992 Dryden ..... 473/570
5,141,229 A 8/1992 Roundy
5,157,405 A * 10/1992 Wycoff et al. ..... 342/386
5,223,667 A * 6/1993 Anderson ..... 102/517
5,269,534 A * 12/1993 Saunders et al. ..... 473/582
5,425,542 A 6/1995 Blackwood et al.
5,516,117 A * 5/1996 Rangel ..... 473/578
5,988,645 A 11/1999 Downing
6,027,421 A 2/2000 Adams, Jr.
6,029,120 A 2/2000 Dilger
6,191,574 B1 2/2001 Dilger
6,209,820 B1 4/2001 Golan et al.
6,390,642 B1 5/2002 Simonton
6,604,946 B2 8/2003 Oakes
6,612,947 B2 9/2003 Porter
6,623,385 B1 9/2003 Cole et al.
7,095,312 B2 8/2006 Erario et al.
7,115,055 B2 10/2006 Palomaki et al.
7,165,543 B2 1/2007 Simo et al.
7,316,625 B2 1/2008 Takahashi
7,331,887 B1 2/2008 Dunn
7,337,773 B2 3/2008 Simo et al.

(Continued)

*Primary Examiner* — John Ricci
(74) *Attorney, Agent, or Firm* — Rhodes Donahoe, LLC; Robert V. Donahoe

(57) ABSTRACT

An electronic apparatus is configured for inclusion in an arrow when shot from a bow. In some embodiments, the electronic apparatus includes a drawn tubular body and a circuit board located at least partly within the drawn tubular body.

26 Claims, 12 Drawing Sheets

(56) References Cited

U.S. PATENT DOCUMENTS

| | | | | |
|---|---|---|---|---|
| 7,909,714 | B2 | 3/2011 | Cyr et al. | |
| 7,927,240 | B2 | 4/2011 | Lynch | |
| 7,931,550 | B2 | 4/2011 | Lynch | |
| 7,993,224 | B2 * | 8/2011 | Brywig | 473/586 |
| 8,251,845 | B2 | 8/2012 | Bay | |
| 8,286,871 | B2 | 10/2012 | Bay | |
| 8,449,414 | B2 | 5/2013 | Donahoe et al. | |
| 8,529,383 | B2 | 9/2013 | Donahoe | |
| 8,585,517 | B2 | 11/2013 | Donahoe | |
| 8,733,168 | B2 | 5/2014 | Donahoe et al. | |
| 2002/0123386 | A1 | 9/2002 | Perlmutter | |
| 2002/0134153 | A1 | 9/2002 | Grenlund | |
| 2004/0014010 | A1 | 1/2004 | Swensen et al. | |
| 2005/0288119 | A1 | 12/2005 | Wang et al. | |
| 2006/0052173 | A1 | 3/2006 | Telford | |
| 2008/0176681 | A1 | 7/2008 | Donahoe | |
| 2008/0242455 | A1 | 10/2008 | Urbain | |
| 2008/0287229 | A1 | 11/2008 | Donahoe | |
| 2010/0035709 | A1 * | 2/2010 | Russell et al. | 473/570 |
| 2010/0248871 | A1 | 9/2010 | Nick et al. | |
| 2013/0170900 | A1 | 7/2013 | Bay | |

* cited by examiner

APPARATUS, SYSTEM AND METHOD FOR ELECTRONIC ARCHERY DEVICE

RELATED APPLICATIONS

This application claims the benefit under 35 U.S.C. §119(e) to U.S. Provisional Application Ser. No. 61/594,631, entitled "APPARATUS INCLUDING ELECTRONIC ARCHERY DEVICE," filed on Feb. 3, 2012, which is herein incorporated by reference in its entirety.

BACKGROUND OF THE INVENTION

1. Field of the Invention

Embodiments of the invention generally relate to archery equipment. More specifically, at least one embodiment, relates to apparatus, system and method for an electronic archery apparatus.

2. Discussion of Related Art

Target archers often use a specialized arrow that is suitable for long distance shooting at which their competition takes place. The arrow (an Easton X-10) has an exceptionally narrow diameter relative to other conventional arrows and can also include a barrel shape where the fore and aft ends have a slightly smaller diameter than a region located somewhere between the ends of the shaft. The X-10 and other narrow diameter arrow shafts employ specialized arrowpoints, and often, unique hardware for attachment of the arrowpoint to the arrow shaft. These narrow diameter shafts are selected by Olympic archers and other competitive target archers because they have a successful track record in competition.

Referring to FIG. 1A, a one piece arrowpoint 10 is illustrated. Arrowpoint 10 includes a tip 12, an extension 14 and two break-off sections 16. The overall mass of the arrowpoint 10 is 120 grains. In a conventional configuration, each of the break-off sections weighs 10 grains. This permits the archer to adjust the weight of the arrowpoint from 120 grains to 100 grains in two 10 grain steps. The arrowpoint 10 is attached to the arrow by inserting the arrowpoint 10 within the hollow cylindrical shaft of the arrow such that the extension 14 and the break-off points are fully located within the arrow shaft and the tip 12 extends forward of the distal end of the arrow shaft. The arrowpoint 10 illustrated in FIG. 1A is constructed of stainless steel. The dimensions and weight that are provided by the arrowpoint 10 result from the density of the stainless steel and the length of each of the sections: the length of the tip 12, the length of the extension 14 and the length of each of the break-off points 16.

In addition to the overall mass, archers using an X-10 arrow often seek an arrowpoint that has a center of mass within a fairly narrow tolerance. In general, the center of mass of the arrowpoints used in Olympic archery is located between approximately the proximate end of the tip 12 and 0.35 inches rear of the proximate end of the tip 12. As should be apparent, the center of mass can shift within the preceding range depending on whether the arrowpoint includes each break-off section, only one break-off section or neither break-off section. In general, however, the change in the center of mass results in the center of mass of the arrowtip 10 staying within the above-mentioned range at or immediately rear of the proximate end of the tip 12 (that is immediately rear of the distal end of the arrow) when the arrowtip 10 is installed in an arrowshaft.

As should be appreciated, the density of the material of the arrowpoint 10 also affects the center of mass. For example, arrowpoints manufactured from tungsten are also a common choice among top target archers. Because tungsten has a significantly higher density than stainless steel, tungsten tips have a reduced overall length and different locations of the center of mass when compared with the stainless steel arrowpoint 10. For example, the lengths of each of the tip 12, the extension 14 and the break-off sections 16 of a 100-120 grain tungsten points have a reduced length relative to the corresponding sections of an arrowpoint manufactured from stainless steel. Here too, however, the center of mass falls within the above-mentioned range for each of the 100, 110 and 120 grain configurations.

Other styles of narrow shaft arrows employ an adapter that allows a threaded attachment of an arrowpoint to the narrow-shaft arrow. Referring to FIG. 1B, one such adapter 20 is illustrated. The adapter 20 includes an insert 22 and an extension 24. The insert 22 can be made of material such as aluminum, brass or steel and includes a threaded region internal to the insert that allows the attachment of an arrowpoint with a threaded shank. The extension 24 is generally made of a hollow aluminum tube that adds weight and, when inserted within the arrow shaft, stiffens the arrow shaft rearward of the insert and the distal end of the arrow shaft.

In practice, the arrowpoint 10 is installed using hot melt glue so that it can later be re-heated and removed from the arrow shaft. For example, extension 14 and break-off sections 16 can be heated, the hot melt can then be applied to the two regions before the arrowpoint 10 is inserted within the hollow-cylindrical arrow shaft. With the arrowpoint 10 fully inserted, the face located at the rear of the tip 12 abuts the forward end of the arrow shaft. To remove the arrowpoint 10, heat is applied to the tip to re-melt the hot melt and allow the extension 14 and break-off sections to be withdrawn from the arrow shaft.

Similarly, the adapter 20 can be glued within the arrow shaft by applying a glue to the extension 24 and the insert and inserting the adapter 20 within the arrow shaft starting with the extension 24 and sliding the adapter within the shaft until the flange 21 abuts the forward end of the shaft. In use, an arrow tip is threaded to the insert 22. To remove the adapter 20, the exposed portion of the arrow tip is heated to re-melt the glue and release the bond between the insert 28 and the extension 24 to allow the adapter 20 to be withdrawn from the shaft.

Referring to FIGS. 9A-9C, a prior art stainless steel arrowpoint 10 is illustrated. Longitudinal dimensions are referenced to a point (x=0) at which the tip 12 abuts the distal end of the arrow shaft when the extension 14 and break-off points 16, if attached, are fully inserted within the arrow shaft. Dimensions to the right of x=0 have positive values while dimensions to the left of x=0 have negative values. FIGS. 9A-9C illustrate that the center of mass ranges from 0.29 inches to −0.04 inches with both break-off sections 16 and no break-off sections, respectively. In general, the preceding illustrates that the center of mass is located substantially from 0.30 inches to 0.0 inches. In addition, FIG. 9B illustrates that a maximum diameter D of the tip 12.

Referring to FIGS. 10A-10C, a prior art tungsten arrowpoint 11 is illustrated. FIGS. 10A-10C illustrate that the center of mass ranges from 0.35 inches to 0.19 inches with both break-off sections 16 and no break-off sections, respectively. In general, the preceding illustrates that the center of mass is located substantially from 0.35 inches to 0.2 inches.

Recently, microelectronic sensing systems have been included in otherwise conventional arrowpoints. These microelectronic systems provide quantified performance feedback that can be used by archers in training to improve the selection and adjustment of their archery equipment, and also to evaluate the archers' form. Such approaches are described in the following applications owned by the assignee of this application: U.S. patent application Ser. No. 12/982,456, entitled "Apparatus, System and Method for Electronic Archery Devices," filed Dec. 30, 2010; U.S. Pat. No. 8,221,273, entitled "Apparatus, System and Method for Archery Equipment," issued Jul. 17, 2012; and U.S. Pat. No. 7,972,230, entitled "System and Apparatus for Archery Equipment," issued Jul. 5, 2011. Each of the preceding patents or patent applications is herein incorporated by reference in its entirety.

The small form factor and specialized nature of the arrowpoints used by target archers and the precise requirements for weight and center of mass create significant barriers to the addition of the microelectronic sensing systems in these arrowpoints. For example, the margin of victory in archery competition is often determined by fractions of an inch following a 50 meter or longer flight of the competitors' arrow. As a result, any electronics added to the arrow must be precisely placed to maintain the flight characteristics as closely as possible to those of the conventional arrow without the sensing system.

Further, conventional arrowpoint construction provides a solid mass that tapers to a point. A solid mass is advantageous for repeated high force target-impacts but is not suitable for integration of electronics. Generally, CNC machining (for example, screw machining) is employed to manufacture arrowpoints suitable for housing electronics. However, these conventional approaches can be challenging and economically impractical to machine tubes that are long enough to house the electronics of an arrowpoint because the tooling must extend down the interior of the tube. In addition, a considerable amount of waste material is produced by such a machining operation.

SUMMARY OF THE INVENTION

In some embodiments, the invention provides apparatus, systems and methods that allow the integration of electronics into an arrowpoint while substantially maintaining any one or any combination of the small form factor, overall mass, center of mass and outside diameter provided by a conventional arrowpoint. According to these embodiments, the flight characteristics of the arrow equipped with the electronic arrowpoint substantially match the flight characteristics of the arrow when equipped with a conventional arrowpoint.

In some embodiments, the housing for an electronic archery apparatus includes thin-walled tubing (for example, a drawn tube) that reduces an overall weight of the apparatus to allow the addition of electronics while matching the weight of a conventional arrowpoint with the electronics. In a further embodiment, such housings also reduce an outside diameter (OD) of the electronic archery apparatus such that an aerodynamic drag of the arrow including the electronic archery apparatus substantially matches an aerodynamic drag of the arrow without the electronic archery apparatus. For example, in one embodiment, the electronic archery apparatus is provided as an arrowpoint with an OD that is substantially equal to or less than the OD of a conventional archery arrowpoint. In another embodiment, such housings have a diameter that is less than an inside diameter (ID) of the arrowshaft in which is installed.

Applicants find that a drawn tube body can be used to achieve the preceding while maintaining sufficient mechanical strength to allow repeated hi-g impacts with conventional archery targets.

As used herein, the terms "match," "matching," and the "substantially" used therewith allow for variations resulting from manufacturing tolerances common in the manufacturing processes generally used in the field.

According to one aspect, an electronic apparatus is configured for inclusion in an arrow when shot from a bow. In some embodiments, the electronic apparatus includes a drawn tubular body; and a circuit board located at least partly within the drawn tubular body. In some embodiments, the drawn tubular body is selected from a group consisting of a seamless tubular body and a welded tubular body.

According to another aspect, an electronic apparatus is configured for inclusion in an arrow when shot from a bow. In some embodiments, the electronic apparatus includes a tubular body; a fitting having an adjustable outside diameter and configured to secure within the tubular body; and electronic circuitry located within the tubular body.

According to still another aspect, an electrically conductive fitting is configured for use in a circuit employed by an electronic apparatus at least partly located in a housing. In some embodiments, the electrically conductive fitting includes a body including a set of threads configured to receive a screw; a movable portion coupled to the body and configured to move outward to expand an outside diameter of a region of the electrically conductive fitting by adjustment of the screw when received by the body; and a conductive surface configured to provide an electrical contact used in the circuit, wherein the movable portion is configured to engage a conductive surface of the housing.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION OF THE INVENTION

Figures 1A, 1B:
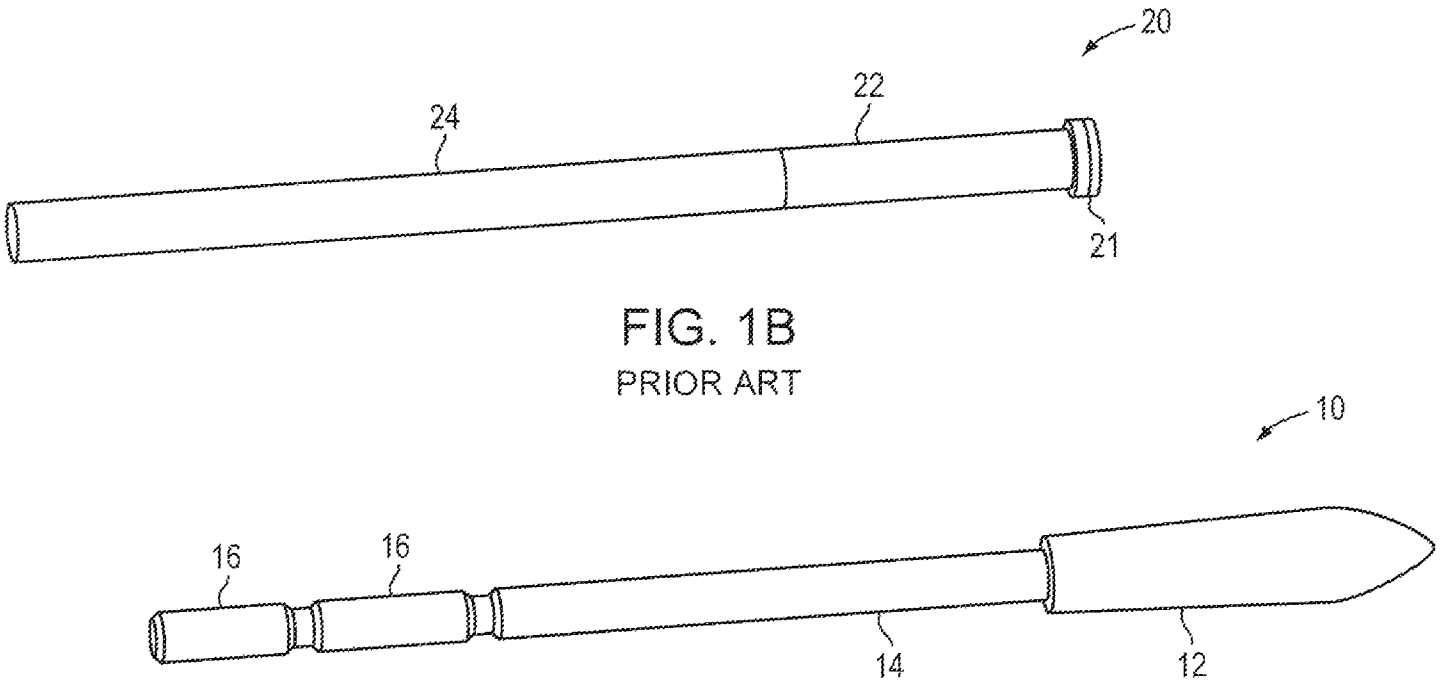
FIG. 1B PRIOR ART
FIG. 1A PRIOR ART
FIG. 1A illustrates an arrowpoint of the prior art.
FIG. 1B illustrates an adapter of the prior art.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein is meant to encompass the items listed thereafter and equivalents thereof as well as additional items.

Figure 2:
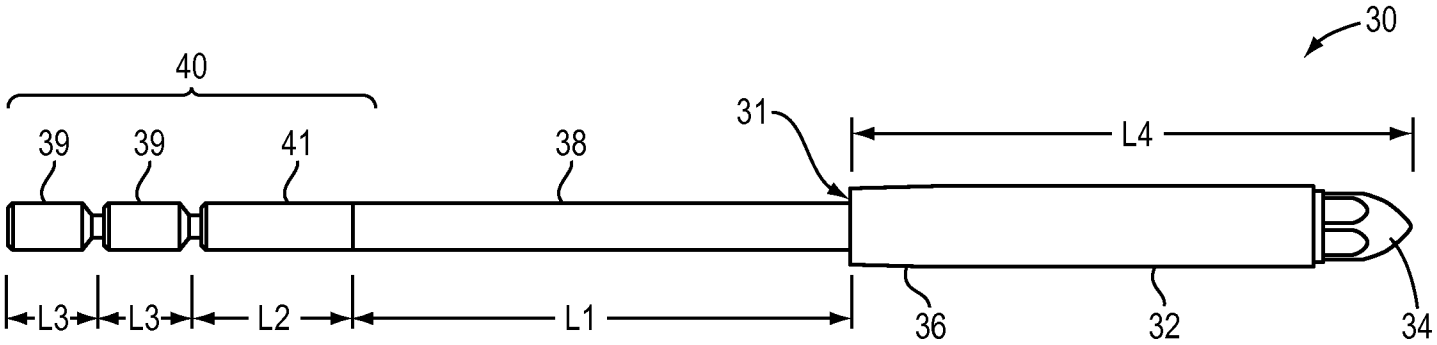
FIG. 2 illustrates an arrowpoint in accordance with one embodiment of the invention.

Referring now to FIG. 2, an electronic arrowpoint 30 is illustrated in accordance with one embodiment. The arrowpoint 30 includes a body 32, a nose 34, an insert 36, an extension 38 and a tail 40. As illustrated, the tail 40 includes two break-off sections 39 and a base 41. In general, the arrowpoint 30 is attached to an arrow shaft by inserting the tail 40 and the extension 38 within the arrow shaft until the surface 31 of the insert 36 abuts the distal end of the arrow shaft. The arrowpoint 30 is fixed in place using hot melt glue in accordance with some embodiments. For example, the tail 40 and the extension 38 can be heated and then hot-melt glue can be applied to the surface of the two regions. As is known by those of ordinary skill in the art, the hot melt glue applied to the surfaces of the extension 38 and tail 40 will secure the arrowpoint 30 in place upon cooling. In other embodiments, alternative bonding agents can be employed, for example, Bohning Cool Flex, which is applied in a similar manner but is releasable when the distal end of the arrowpoint is run under hot tap water.

In the illustrated embodiment, the extension 38 has a length L1. Each of the break-off sections 39 has a length L3 and the base 41 has a length L2. In addition, the exposed region of the arrowpoint 30 when attached to the arrow shaft includes the body 32, the nose 34, and the insert 36. In accordance with this embodiment, an overall length of the exposed region of the arrowpoint 30 is L4.

In accordance with some embodiments, the body 32 houses a printed circuit board and/or other electronics, which, for example, are employed to collect flight-data when the arrow that the arrowpoint 30 is attached to is shot from a bow. The printed circuit board (PCB) can include a microcontroller, external memory, sensors (for example, an accelerometer) and different active and/or passive components either alone or in combination with the preceding and other components. The dimensions of the exposed region of arrowpoint 30 can be affected by the size and shape of the printed circuit board and/or other electronic components in the body 32. For example, a shorter PCB can result in length L4 being reduced relative to embodiments in which a longer PCB is located within the body 32 of the arrowpoint 30. Changes in the length L4 can also affect the overall center of mass of arrowpoint 30. As will be described further herein, some embodiments of the arrowpoint 30 are designed so that the flight characteristics of the electronic arrowpoint substantially match the flight characteristics of a conventional arrowpoint (for example, the arrowpoint 10). For example, the arrowpoint 30 can be configured such that an arrow equipped with it has substantially the same drag as an arrow equipped with a conventional arrowpoint. To achieve the preceding or other objectives, the size and weight of the various components of the arrowpoint 30 (and the overall center of mass) can be selected to meet the performance objectives (including drag) that are desired.

The extension 38 can include a solid or hollow configuration depending on the embodiment. Further, various materials of construction can be used for the extension 38. The materials of construction can be selected to achieve a desired length and weight of the arrowpoint 30. In one embodiment, the extension 38 is manufactured from aluminum while in another embodiment the extension 38 is manufactured from stainless steel. In still another embodiment, the extension 38 is manufactured from tungsten. According to one embodiment, the insert 36 is attached to the extension 38 by glue, press fit, or other mechanical attachment (for example, crimped) where the insert 36 and the extension 38 are separate components. In accordance with another embodiment, the insert 36 and the extension 38 are manufactured from a single piece of material and attachment of separate components to one another is unnecessary. In yet another embodiment, the insert 36, the extension 38 and the tail 40 are all manufactured from a unitary piece of material such that an attachment of separate components is not required. Thus, in accordance with one embodiment, at least the insert 36 and extension 38 are machined from a single piece of material. In a further embodiment, electrical discharge machining (EDM) is used to manufacture at least a portion of the insert 36 including extension 38. In a still further embodiment, a combination of EDM and screw-machining are employed.

In the illustrated embodiment, the body 32 of the arrowpoint 30 is detachably attached to the insert 36. However, in yet another embodiment, the body 32, the insert 36, the extension 38 and the tail 40 are all manufactured from a single unitary piece of material such as stainless steel, brass, aluminum, tungsten, or plastic.

In accordance with one embodiment, the tail 40 is manufactured from tungsten. In accordance with these embodiments, the increased density of tungsten relative to other materials of manufacture helps the arrowpoint 30 achieve the desired center of mass by moving a desired part of the overall mass of the arrowpoint 30 rearward within the arrow shaft.

Where the tail 40 is a separate component of the arrowpoint 30, depending on the embodiment, the tail can be attached to the extension by any of: glue/epoxy; a press fit achieved by applying a force axially along the longitudinal axis of the components (where the press fit can be facilitated using a "thermal" press fit); using a pin or other fastener to attach the tail to the extension; or by crimping one component to the other. Further, according to various embodiments in which the tail is a separate component, the tail 40 can manufactured from a single unitary piece of material such as stainless steel, brass, aluminum, tungsten, or plastic.

Figure 12A:
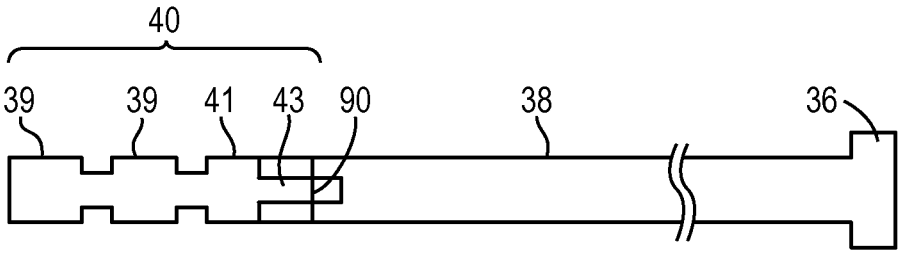
FIGS. 12A-12B illustrate a portion of an arrowpoint in accordance with one embodiment.
Figure 12B:
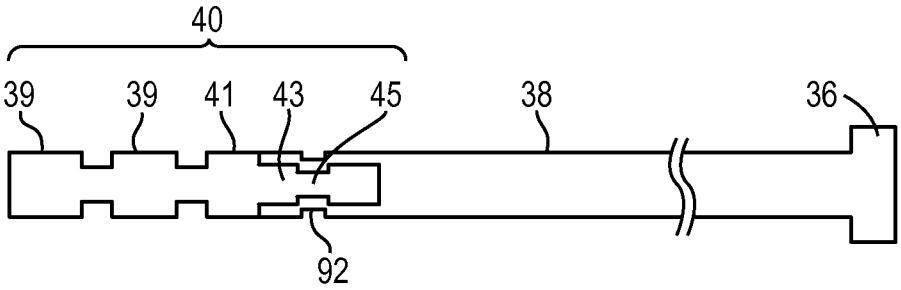

Referring now to FIGS. 12A and 12B, embodiments for fastening the tail 40 to the extension 38 are illustrated. As should be appreciated, the approaches illustrated in FIGS. 12A and 12B can be employed in embodiments where the extension 38 and tail 40 are separate components. FIG. 12A illustrates an embodiment where the base 41 of the tail 40 includes a region 43 that has a reduced diameter to allow the region 43 to be located within a hollow cylindrical space within the extension 38. The illustrated embodiment also includes a pin 90 used to fasten the tail 40 to the extension 38. In FIG. 12A, a through hole is located in the region 43 and corresponding holes are located in the walls of the hollow cylindrical region at the proximate end of the extension 38.

The components are assembled by inserting the region 43 within the extension 38, rotating the extension 38 and tail 40 relative to one another to align the holes, and inserting the pin 90 in the hole. In one embodiment, the diameter of the holes is slightly undersized and the pin 90 is press fit to securely locate in place. In a further embodiment, the length of the pin is sized so that it is long enough to reach from one side wall of the extension to the sidewall 180 degrees opposite. In addition, the length of the pin can be sized so that it is short enough such that neither of the opposing ends are exposed outside the walls of the extension 38 when the pin is secured in place. That is, the length of the pin is less than the outside diameter of the extension 38 in the region where it is attached to the tail 40.

FIG. 12B also illustrates an embodiment where the base 41 of the tail 40 includes the region 43 that has a reduced diameter to allow the region 43 to be located within a hollow cylindrical space within the extension 38. In addition, the region 43 also includes a recessed region 45 in the illustrated embodiment. The recessed region 45 is further reduced in diameter relative to the diameter of the region 43. In the illustrated embodiment, a region 92 of the extension 38 is used to apply a compression fit to the tail 40. According to some embodiments, a crimping tool or other device is employed to deform the region 92 into the recessed region 45. However, a radially inward pressure can be applied with different tools or equipment depending on the embodiment provided they result in the tail 40 being securely fastened to the extension 40.

The components illustrated in FIG. 12B are assembled by inserting the region 43 within the extension 38. Compression is applied around the region 92 and the recessed region 45 to press the walls of the extension 38 into the recessed region 45. In some embodiments, the recessed region 45 is located about the entire circumference of the region 43 while in other embodiments discrete sections each providing a recessed region together provide the region into which the walls of the extension are pressed.

The preceding embodiments of FIGS. 12A and 12B can also include a glue (for example, an epoxy) to assist in securing the tail 40 to the extension 38. In an alternate embodiment, the tail 40 is glued to the extension 38 using glue without any other fastening.

Referring again to FIG. 2, in accordance with various embodiments, the body 32 of the arrowpoint 30 is a hollow cylindrical tube that can be manufactured from any one of, for example, hardened brass, stainless steel, tungsten, plastic, carbon fiber, or other material provided it has suitable strength to withstand impact with a conventional archery target. Advantages of employing a tube-style body 32 can include reduced weight and manufacturing costs while maintaining sufficient strength and in some embodiment's conductivity for electrical connection with a PCB or other electronics housed therein. According to some embodiments, the tubing is a welded tubing, while in other embodiments the tubing is a seamless tubing. The preceding embodiments may be manufactured in a process that includes heat treating and/or cold drawing to improve the characteristics of the tubing, for example, to provide a stronger body 32 for the arrow tip 30.

In some embodiments, the body 32 for the arrowpoint 30 includes thin-walled tubing (for example, a drawn tube) that reduces an overall weight of the body 32 to allow the addition of electronics to the arrowpoint 30 while achieving an overall arrowpoint weight that substantially matches the weight of a conventional arrowpoint. In a further embodiment, such housings also reduce an outside diameter (OD) of the arrowpoint 30 such that an aerodynamic drag of the arrow including the arrowpoint 30 substantially matches an aerodynamic drag of the arrow with a conventional arrowpoint. In one embodiment, the arrowpoint 30 includes a maximum OD that is substantially equal to a maximum OD of a conventional archery arrowpoint to provide a comparable aerodynamic drag.

Depending on the embodiment, manufacturing processes that can be used to produce a drawn tube body (whether for an arrowpoint or other electronic apparatus) include any one, any combination of or any combination of the following and other manufacturing processes: tube sinking, rod drawing, float plug drawing, tethered plug drawing and fixed plug drawing.

In some embodiments, the body 32 includes conductive tubing that is electrically connected to a PCB located within the body 32. For example, the body 32 can be employed as a conductor in a communication circuit and/or a power circuit. In these embodiments, it is desirable to form an electrical connection between the body and the PCB. In one embodiment, solder pads on the surface of the PCB are located to engage one or more slotted regions of the body 32 or an associated fitting in an interference fit. In other embodiments, a conductive component (for example, an un-insulated conductor) is located on the PCB to engage the interior wall of the body 32 to complete an electrical connection when the PCB is inserted within the body 32. In still other embodiments, the PCB includes edge plating and the conductively plated edges of the PCB engage the interior wall of the body 32 to complete an electrical connection when the PCB is inserted within the body 32. In various embodiments, the preceding approaches can achieve an electrical contact between the PCB and the body 32 without the use of fasteners or any bonding material such as glue joints, solder joints and the like.

According to various embodiments, the PCB can have components located on either or both sides. Further, the components can be mounted to the PCB surface via surface mounting, through hole mounting or other means. According to one embodiment in which edge plating is employed, the edge plating provides an electrical connection to material of the ground plane of the PCB (for example, conductive foil such as copper foil). In a further embodiment, the PCB includes a multi-layer PCB and the edge plating completes an electrical connection to more than one layer of conductive material of the PCB, for example, couples multiple layers of material of the ground plane. According to these embodiments, the edge plating completes an electrical connection to the interior wall(s) of the body 32 when the PCB is located in the body 32.

Figure 3:
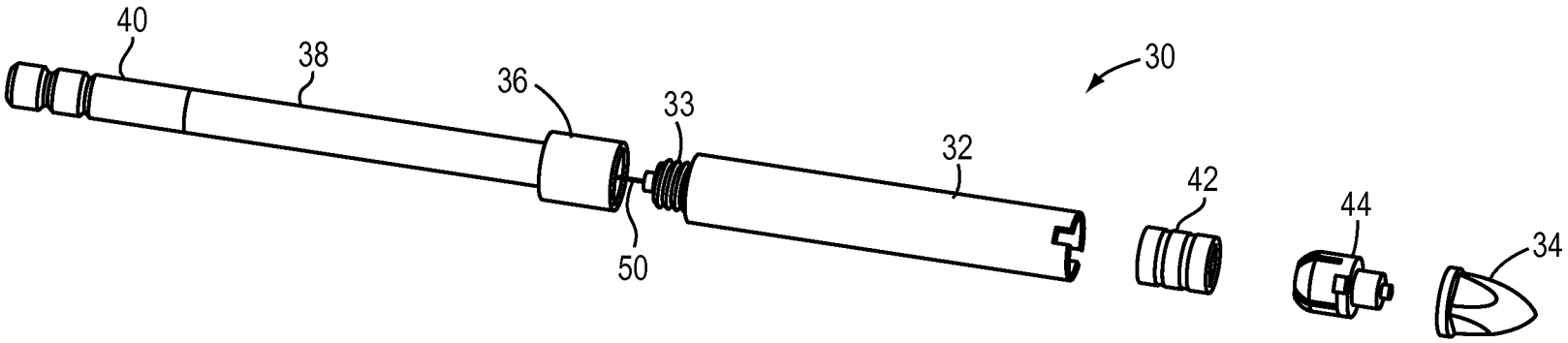
FIG. 3 illustrates a partially exploded view of the arrowpoint of FIG. 2.

Referring to FIG. 3, the electronics included in the body 32 are powered by battery pack 42 which may include one or a plurality of coin-cell batteries. As illustrated, the battery pack 42 includes three coin-cell batteries secured together using a heat shrinkable material. According to one embodiment, a region forward of the PCB allows insertion of the battery pack 42 in the body 32. In addition, the arrowpoint 30 includes a front fitting 44 that in various embodiments is employed to fix the location of at least the battery pack 42 within the body 32 when the arrowpoint 30 is fully assembled. The front fitting 44 is slid within the distal end of the body 32 to fix the location of all the components relative to one another. In addition, in the illustrated embodiment, the nose 34 is attached to the remainder of the arrowpoint 30 using a threaded connection.

In accordance with some embodiments, the nose 34 is manufactured from a plastic material to reduce the amount of weight located at the distal end of the arrowpoint 30. According to other embodiments where it may be desirable to have additional weight forward, the nose 34 can be manufactured from material having a higher density such as aluminum, brass, stainless steel or tungsten as just some examples. That is, the nose can be manufactured of a material designed to achieve a desired center of mass of the overall arrowpoint 30.

Because the nose 34 is located at the point of impact for each shot, the material of construction can also be selected to provide a desired durability and impact resistance. Both the impact strength and the tensile strength of the material can be evaluated. For example, in one embodiment, the material is selected from among glass reinforced polycarbonate and un-reinforced polycarbonate. In one embodiment, the selection is made primarily based on the impact strength of the material. In this embodiment, is selected based on having the higher impact strength. However, because the nose includes detailed structural features such as threads, the other factors may be more heavily weighted in the selection. For example, the un-reinforced polycarbonate can have half the tensile strength and lower flexural and compression strength than glass reinforced polycarbonate. Thus, in some embodiments, glass reinforced polycarbonate is employed to reduce or eliminate deformation that might otherwise occur for the detailed features of the nose following a series of target-impacts. According to yet another embodiment, a glass filled nylon is selected for the material of the nose 34 because glass filled nylon has increased impact strength, flexural strength and compression strength compared to polycarbonate. These characteristics help reduce the likelihood that the nose 34 will shatter or deform despite repeated hi-force impacts with an archery target.

In the illustrated embodiment, the body 32 includes a threaded region 33 located and extending from a proximate end of the body 32 to allow a threaded attachment of the body 32 including the electronics to the insert 36. In some embodiments, the threaded region 33 and the body 32 are manufactured from an integral piece of material that does not require any attachment of the threaded region 33 to the body 32. In accordance with other embodiments, the threaded region 33 is included as part of a rear fitting that is attached to the proximate end of the body 32 via any of, for example, glue, press fit, or other mechanical attachment.

The removable aspect of at least a portion of arrowpoint 30 allows a user to take one or more shots to collect flight data with the arrowpoint 30 and then remove the electronic portion of the arrowpoint 30 such that the flight data can be downloaded and processed for display and evaluation by the user, and to do so, without the need to remove the insert 36, extension 38 and tail 40 from the arrow. The embodiments of the arrowpoint 30 illustrated in FIG. 3 can include hard wired communication to external devices. For example, a communication interface 50 (including a communication conductor or plurality of communication conductors) can be included in the arrowpoint 30 such that the flight data can be communicated to the external device via a hardwired connection for processing and display.

In the illustrated embodiment, the removable attachment of the body 32 to the insert 36 allows the connection of the communication interface 50 to an external device (or devices) when the body 32 is removed from the insert 36, which can remain attached to the arrow shaft. In accordance with one embodiment, a hardwired communication interface can be located at a distal end of the body 32 (or elsewhere) so that it is externally accessible with the arrowpoint 30 inserted in the arrow shaft. According to these embodiments, removal of the body from the insert and/or arrow is not required. Instead, with the electronic portion of the arrowpoint 30 still attached to the arrow, the flight data can be downloaded for processing and displayed. That is, in some embodiments, the communication interface 50 is accessible for the downloading of flight data while the arrowpoint 30 remains attached to the arrow shaft. In yet another embodiment, the electronics can be removable from the body 32 such that the body 32 remains attached to the arrow shaft while the PCB or other electronics are removed and information is downloaded from the electronics to an external device. In still another embodiment, a wireless communication of flight data can be employed such that the arrowpoint 30 remains attached to the arrow shaft and a user elects to wirelessly transfer flight data from the arrowpoint 32 an external device for processing and display.

Figure 4:
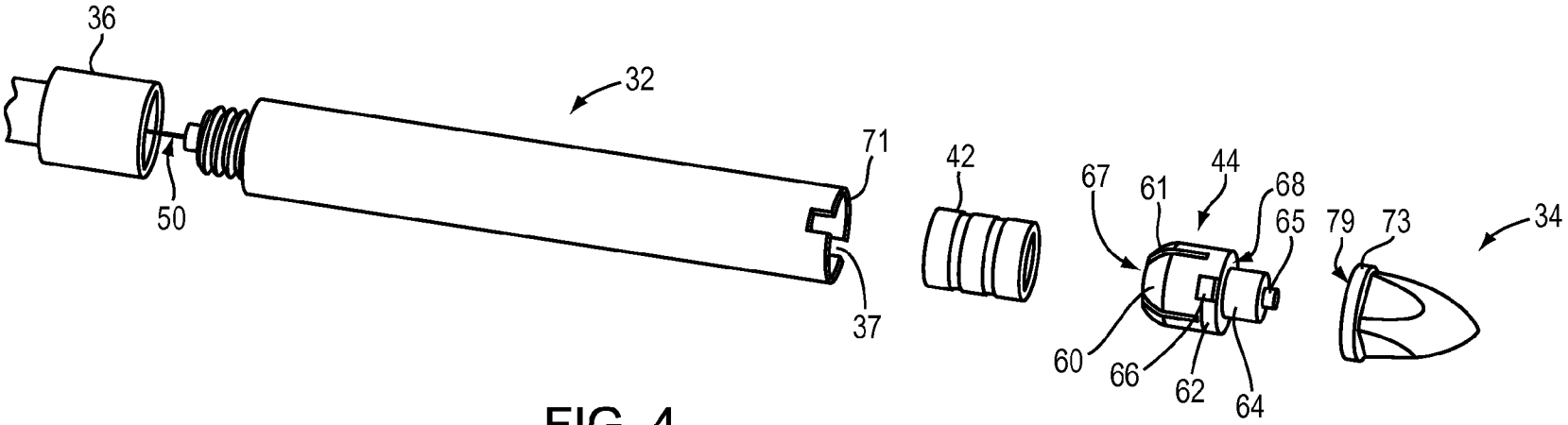
FIG. 4 illustrates a close up of a partially exploded view of the arrowpoint of FIG. 3.

Referring now to FIG. 4, a close up view of the arrowpoint 30 of FIG. 3 is illustrated. The illustrated embodiment shows that in some embodiments the body 32 includes one or more notches 37 that can be used to engage with other elements of the arrowpoint 30 to secure components in place and/or aid in assembly of the arrowpoint.

In the illustrated embodiment, the front fitting 34 is an expandable device (for example, similar to a chuck) that can be inserted within a hollow region of the body 32 and mechanically expanded to securely lodge in place in the hollow region of the body 32. In the illustrated embodiment, the front fitting includes a plurality of moveable regions 60 a plurality of gaps or slots 61 located between moveable regions 60, a rim 62, a threaded region 64, a screw 65, a tab 66, and a contact surface 67.

In accordance with the illustrated embodiment, the front fitting is slid within the body 32 such that the tab or tabs 66 lodge within corresponding notch(es) 37. Prior to locating the front fitting in the body 32, the battery pack 42 is inserted in place such that the proximate end of the battery pack makes contact with an electrical connection to the electronics included in the body 32. The dimensions of the front fitting are such that the contact surface 67 is pressed against a region of the distal end of the battery pack 42 (for example, a positive or negative pole of the battery pack 42). When the front fitting 44 is fully inserted within the body 32, the screw 65 is then threaded into the front fitting 34 such that the moveable regions 60 expand outward to apply a friction fit against the interior walls of the body 32. According to other embodiments, the tab or tabs 66 are not employed.

Where the fitting 44 is manufactured from a conductive material, the outside surface of the fitting (for example, the rim 62 or other radially exterior surfaces of the fitting 44) can provide an electrical contact surface that makes contact with the interior walls of the body 32. Thus, when the fitting is located within the body 32, for example, a conductive body, the fitting provides an electrically conductive path from the contact surface 67 to the interior walls of the body 32.

With the front fitting lodged within the body 32, access to the screw 65 is no longer necessary and the nose 34 is attached to the front fitting 34 via a threaded connection at the threaded region 64. In the illustrated embodiment, the preceding can occur with either the body 32 attached to the insert 36 or free of the insert. In one example, the fully assembled body and nose 34 with the other illustrated components is attached to the insert 36 and the fully assembled arrowpoint 30 is glued in place at the distal end of the arrow shaft. As can be seen in the illustration, the communication interface 50 is inserted within a hollow region of the insert 36 and extension 38 when the body 32 is attached to the insert 36.

In accordance with some embodiments, the contact surface 67 of the fully expanded front fitting 34 has a diameter that is less than or equal to the maximum diameter of the pole of the battery with which it makes contact when the front fitting is secured in place in the body 32.

Figure 5:
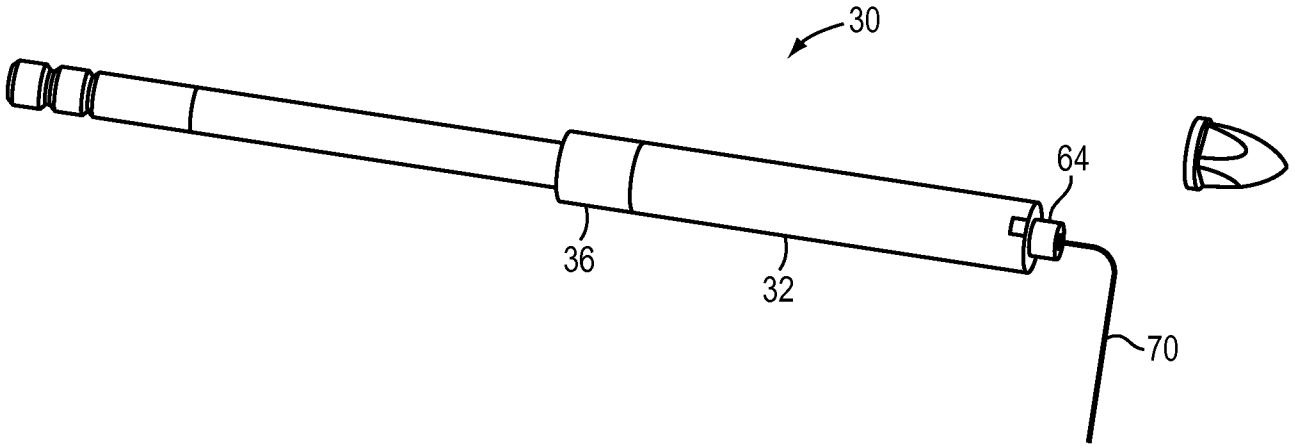
FIG. 5 illustrates a partially disassembled view of the arrowpoint illustrated in FIG. 2.
Figure 6C:
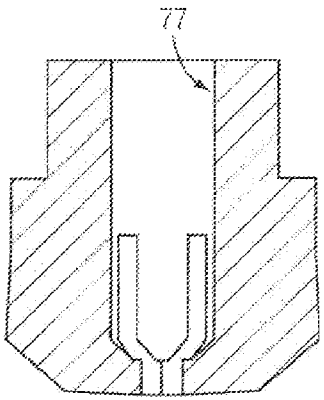
FIGS. 6A-E illustrate a fitting for an arrowpoint in one embodiment of the invention.
Figure 6E:
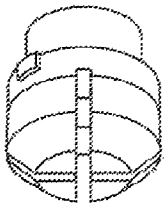
Figure 6B:
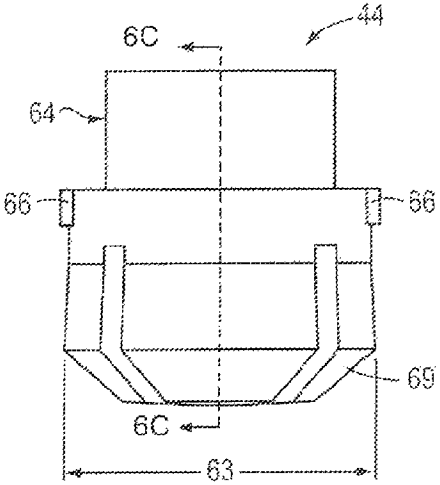
Figure 6D:
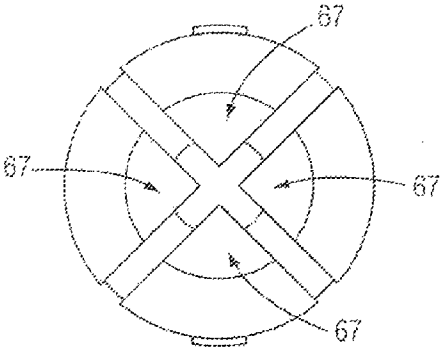
Figure 6A:
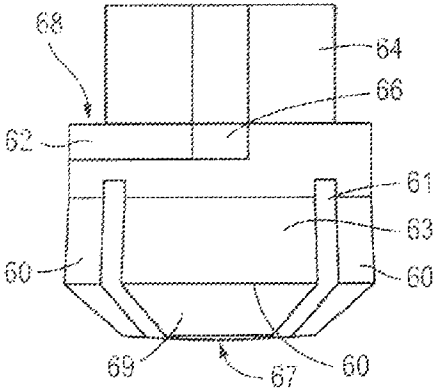
Figure 7A:
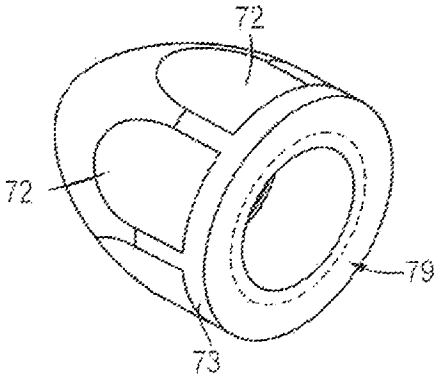
FIGS. 7A-7E illustrate a nose for an arrowpoint in one embodiment.
Figure 7B:
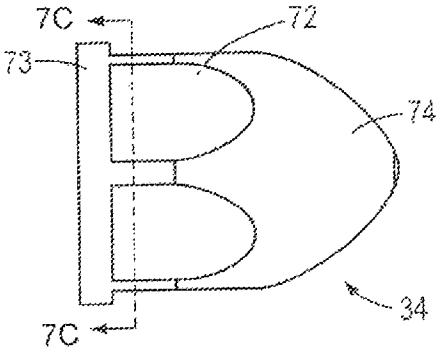
Figure 7C:
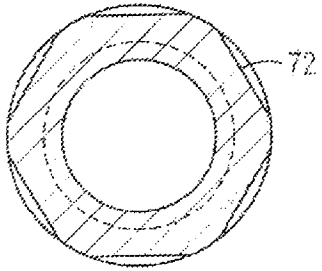
Figure 7D:
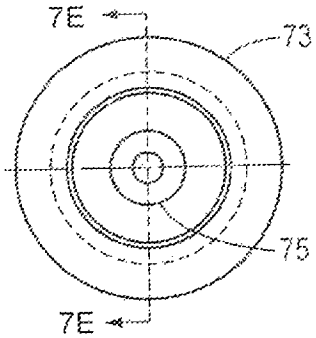
Figure 7E:
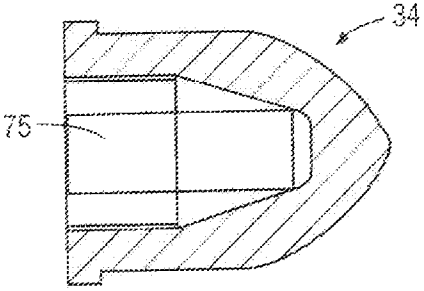
Figure 8B:
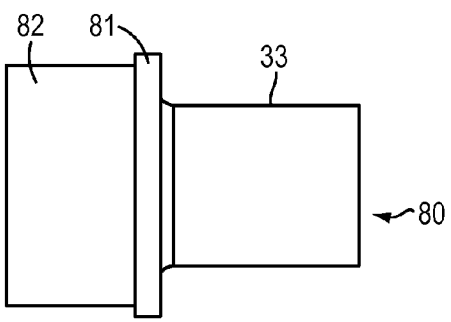
FIGS. 8A-8D illustrate a fitting for an arrowpoint in a further embodiment.
Figure 8C:
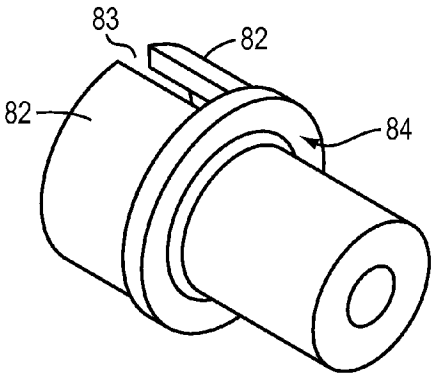
Figure 8A:
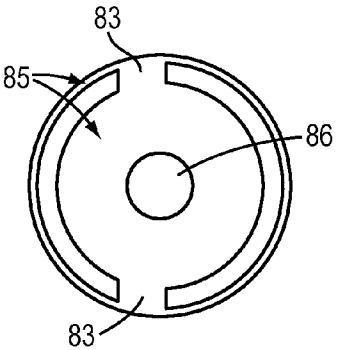
Figure 8D:
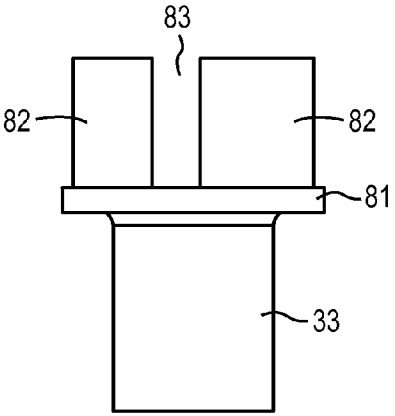
Figures 9A, 9B, 9C:
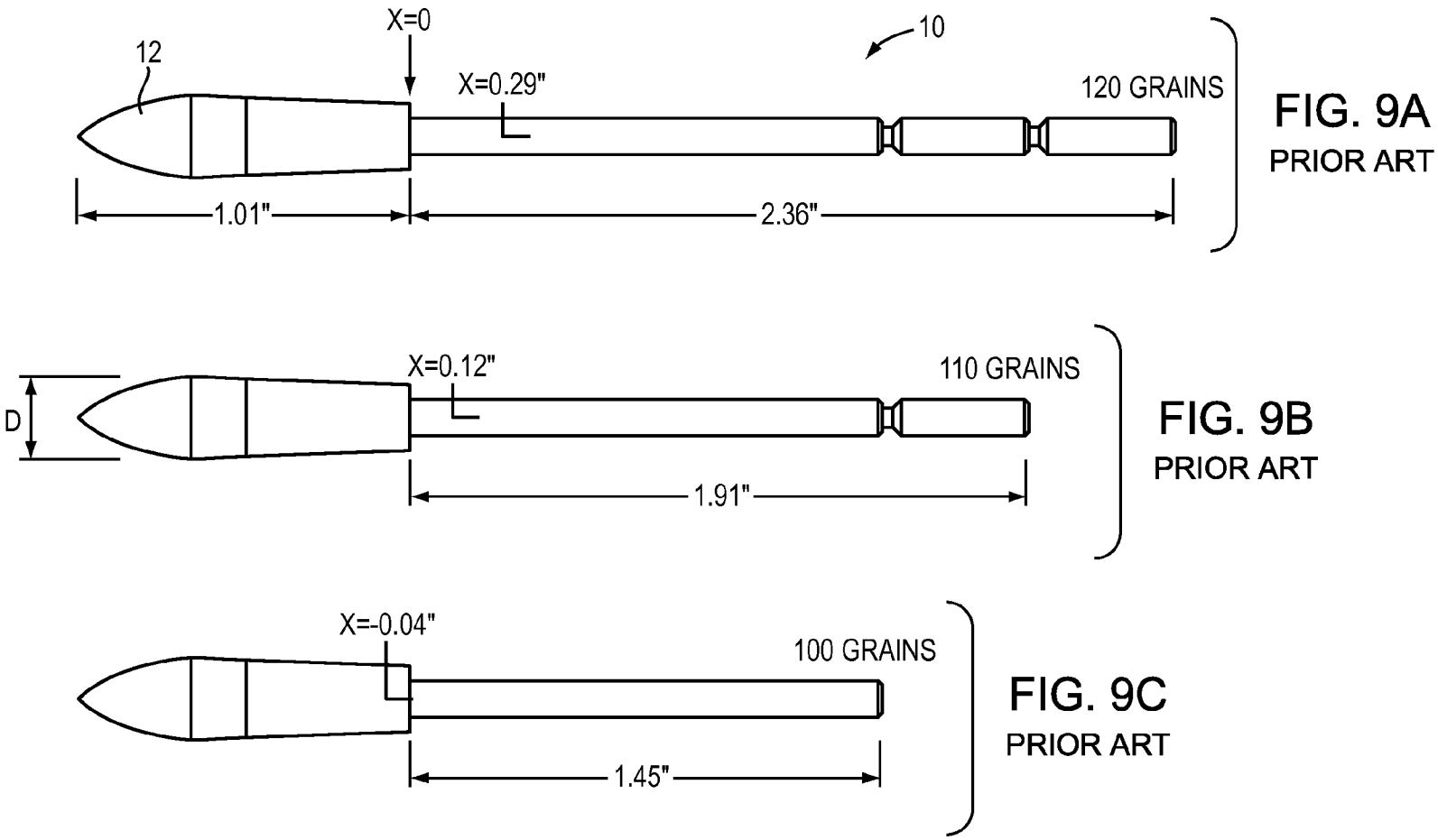
FIG. 9A PRIOR ART
FIG. 9B PRIOR ART
FIG. 9C PRIOR ART
FIGS. 9A-9C illustrate a stainless steel arrowpoint of the prior art.
Figures 10A, 10B, 10C:
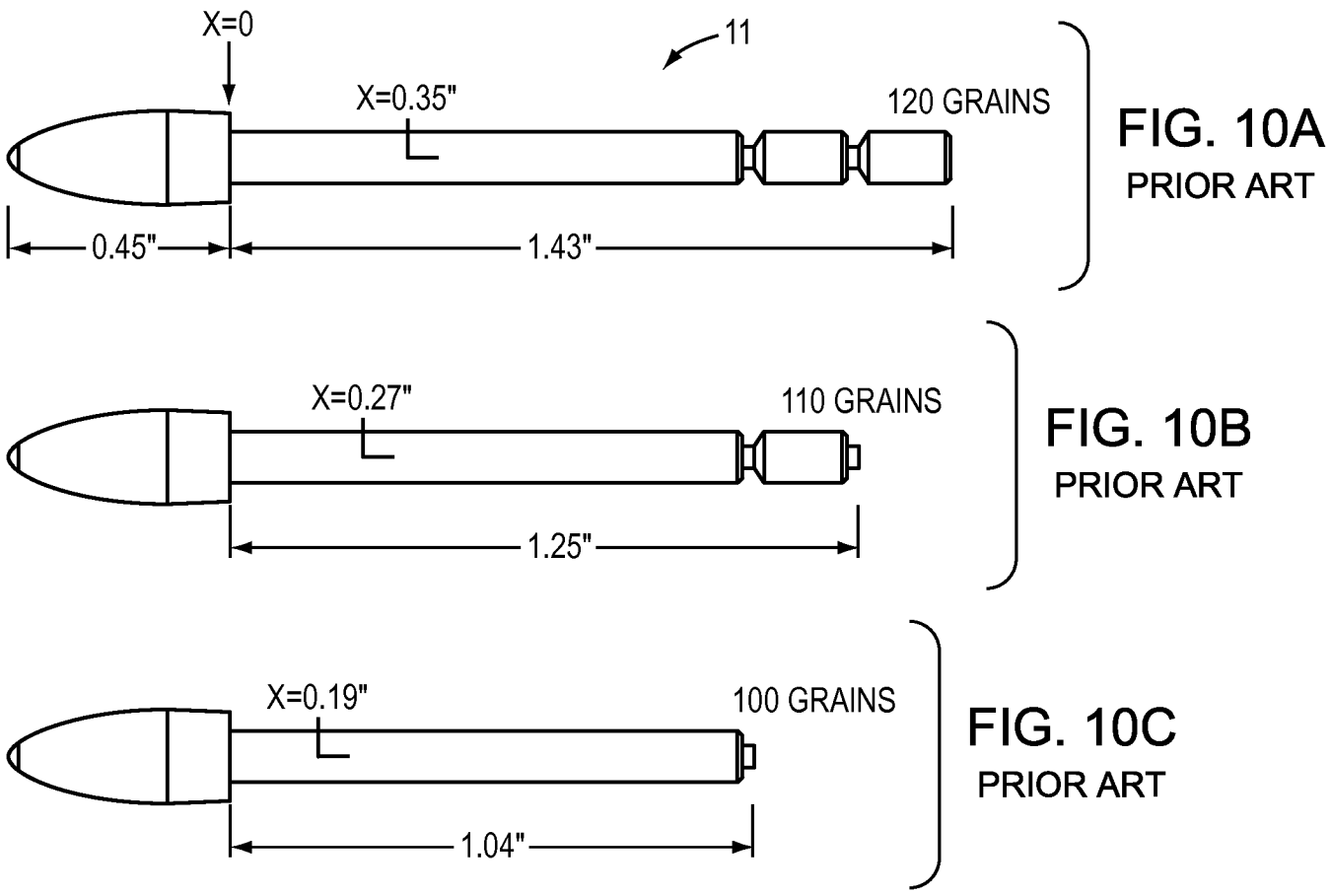
FIG. 10A PRIOR ART
FIG. 10B PRIOR ART
FIG. 10C PRIOR ART
FIGS. 10A-C illustrate a tungsten arrowpoint of the prior art.

A screw 65 can be employed to expand the front fitting and secure it in place within the body 32, once it is inserted to the proper depth. In FIG. 5, a wrench 70 is employed to aid in the insertion and removal of the screw 65 within the front fitting 34. For example, the front fitting 44 can be inserted so the contact surface 67 engages the distal pole of the battery pack 42. In some embodiments, the surface 68 is recessed within the hollow region below the rim 71 with the front fitting 44 fully inserted within the body 32. With the nose 34 attached in this configuration, shock, on impact with the target, is transmitted directly from the nose 34 to the body 32 where the surface 79 of the rim 73 meets the rim 71 of the body 32. The preceding approach can be used to reduce or eliminate the impact forces that would otherwise be directly transmitted from the nose to battery pack 42 via the front fitting 44. This is advantageous because impact forces can otherwise deform the contact surface of the coin cell batteries included in the battery pack 42.

According to one embodiment, the screw 65 can be inserted within a threaded region internal to the front fitting 44 and the wrench 70 can be used to thread the screw into the front fitting 44 to expand the moveable regions 60. The nose 34 is then attached to the threaded region 64 of the front fitting 44. In this embodiment, the arrowpoint 30 is disassembled to replace the batteries and/or access the electronics by reversing the process: 1) removing the nose 34; 2) using the wrench 70 to at least partially withdraw the screw 65 from the front fitting 44; and 3) withdrawing the front fitting 44 from the body 32.

According to an alternate embodiment, the front fitting 44 is threaded within the body 32 and an interference or friction fit between the fitting 44 and the body 32 is not used. According to this embodiment, moveable regions are not included in the front fitting 44. Instead, a solid front fitting can be used where at least a portion of the side walls of the front fitting 44 are threaded to engage a threaded region located on the interior walls of the hollow region of the body 32. According to this embodiment, the threaded region can include integral headless fitting (for example, it can be keyed for an allen head or other style wrench). The preceding feature can be located in a radially central region of the front fitting 44. In another embodiment, the threaded region 64 includes flat surfaces located on opposite sides of the region 64 to allow a wrench (for example, a crescent wrench) to be used to grip the front fitting for installation and removal of the fitting. In some of the immediately preceding embodiments, the fitting 44 is solid and does not include any gaps 61 or moveable regions 60 because an expandable fitting design is not used.

According to some embodiments, voids that surround the PCB with it fully inserted in the body 32 are filled with an epoxy to permanently and securely fix the location of the PCB within the body 32.

Referring now to FIG. 6, the front fitting 44 is illustrated in accordance with one embodiment. In accordance with the illustrated embodiment, the moveable regions 60 are shown as well as gaps 61 between moveable regions. In the illustrated embodiment, the moveable regions 60 form an area of uniform diameter 63 and a tapered region 69 such that the moveable regions are narrower at the proximate end of the front fitting 34 where they form the contact surface 67. In addition, the threaded region 64 is illustrated as well as an internal threaded region 77 that is used to engage the screw 65 when it is attached to the front fitting 34. In the illustrated embodiment, the locations of the tabs 66 on opposite sides of the rim 62 are shown. In accordance to another embodiment, a single tab 66 is employed to fix the rotational position of the front fitting as the screw is engaged with the fitting 44. According to another embodiment, tabs are not employed.

Referring now to FIG. 7, the nose 34 is illustrated in accordance with one embodiment. According to the illustrated embodiment, the nose includes a series of flat regions 72, a rim 73, and a tip 74. The flat region 72 can be used to grip the nose 34 to thread it on and off of the front fitting 34. According to some embodiments, a wrench or other tool can also be used to grip the nose 34 as it is rotated or as it is attached to or detached from the front fitting 34. According to another embodiment, the nose 34 does not include any flat regions. Instead, a smooth surface that tapers from the tip 74 to the rim 73 is employed. In addition, a hollow region 75 within the nose 34 is illustrated. In the illustrated embodiment, a portion of the hollow region 75 is threaded to allow the nose 34 to be attached to the threaded region 64 of the front fitting 44.

Referring now to FIG. 8, a rear fitting 80 that is located at the proximate end of the body 32 is illustrated in accordance with one embodiment. The rear fitting 80 includes the threaded region 33, a flange 81, walls 82, slots 83, a first surface 84, a second surface 85 and a thru hole 86. According to the illustrated embodiment, the walls 82 are slid within the body 32 until the body abuts the second surface 85 on the distal side of the flange 81. In some embodiments, the walls 82 of the fitting 80 are attached to the body 32 with an adhesive while in other embodiments the walls are braised or welded to the walls of the body. In yet another embodiment, a press fit is used such that the walls 82 of the rear fitting 80 are secured within the body 32 by an interference (or friction) fit without the use of an adhesive. A thermal fit can be employed, for example, the body can be heated while the rear fitting can be cooled such that the temporary thermal difference in the two pieces allows the rear fitting to be inserted within the body. When the two pieces return to a common ambient temperature the rear fitting is secured within the body by a shrink fit. In yet another embodiment, the attachment of the rear fitting 80 within the body 32 is achieved alone or is assisted by potting compound (for example, epoxy) being inserted within the body 32. The preceding can provide a substantially permanent bond between the rear fitting 80 and the body 32. In a further embodiment, the walls 82 can include a hole that increases the strength of the bond by increasing the surface area that is used to bond the two components.

According to some embodiments, the rear fitting 80 receives a PCB that is located within the body 32. In the illustrated embodiment, the slots 83 between the walls 82 are sized to allow a proximate end of the PCB to be inserted between them. For example, with the rear fitting 80 assembled with the body 32, a fully assembled PCB is inserted in the distal end of the body 32 and slid rearward so that the distal end of the PCB is located in the slots 83 and abuts the second surface 85 of the fitting 80. According to one embodiment, an electrical connection is made between the PCB and the walls 82 of the rear fitting 80 at the slots (for example, a friction fit between the walls and solder pads located on the PCB can create the electrical connection).

According to a further embodiment, the thru hole 86 extends from the second surface 85 through the threaded region 33 of the rear fitting 80. In some embodiments, the communication interface 50 is externally accessible at the distal end of the thru hole 86. For example, where a hardwired communication interface is employed, one or more communication conductors can extend from electronics internal to the body 32 through the thru hole 86 to allow a communication connection between the electronics and another device (for example, a docking station). The communication interface 50 can include a parallel communication interface or a serial communication interface (for example, a USB). Depending on the embodiment, a hardwired communication interface is not employed, for example, the communication interface can include an optical communication interface.

Although referred to as a fitting, it should be apparent that the rear fitting 80 need not be a separate component and can instead be included as an integral element that includes the features illustrated for the rear fitting 80 and a tubular housing for the electronics such as the body 32.

Figure 11A:
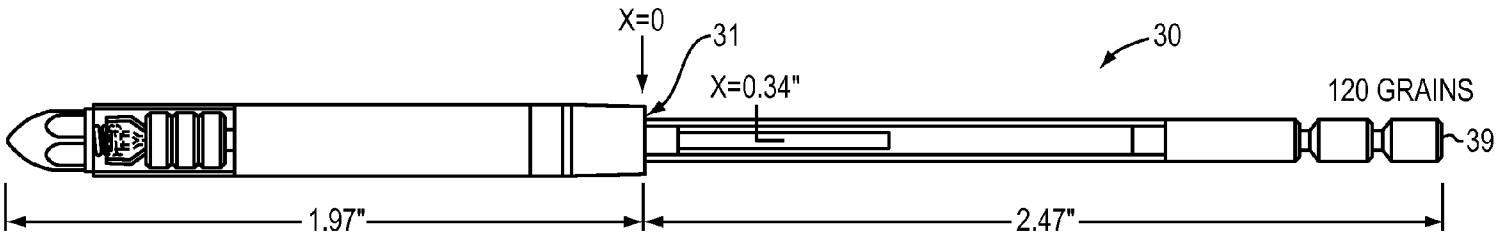
FIGS. 11A-11C illustrate an arrowpoint according to an embodiment of the invention.
Figure 11B:
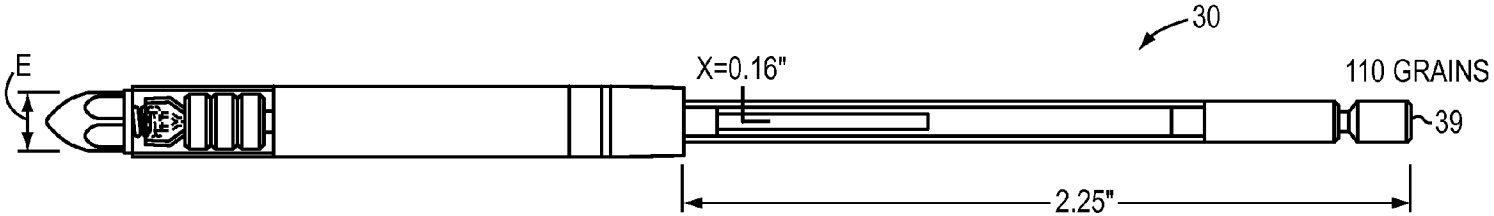
Figure 11C:
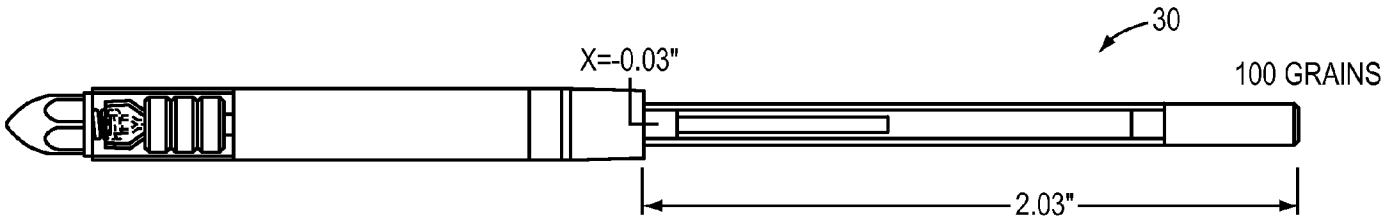

As mentioned above, it is desirable to provide the electronic arrowpoint 30 with an overall weight and center of mass that closely matches the characteristics of a conventional arrowpoint. Such an approach will ensure that an arrow equipped with the electronic arrowpoint 30 provides flight characteristics that closely match flight characteristics of the arrow when equipped with the conventional point. FIGS. 9A-9C and 10A-10C illustrate the dimensions, weights and location of the center of mass for two conventional arrowpoints. FIGS. 11A-11C illustrates the preceding characteristics for the electronic arrowpoint 30 in accordance with one embodiment.

Referring to FIGS. 11A-11C, an embodiment of the arrowpoint 30 is illustrated. Here, the point x=0 is a location of the surface 31 previously referred to with reference to FIG. 2. FIGS. 11A-11C illustrate that the center of mass ranges from 0.34 inches to −0.03 inches with both break-off sections 39 and no break-off sections, respectively. In general, the preceding illustrates that the center of mass is located substantially from 0.35 inches to 0.0 inches.

In addition, FIG. 11B illustrates that a maximum diameter E of the region of the arrowpoint 30 that is exposed with the arrowpoint 30 fully installed in the arrow shaft. In accordance with various embodiment, the maximum diameter E is less than or equal to the maximum diameter D of the conventional arrowpoint 10, FIG. 9B. According to these embodiments, the construction of the arrowpoint 30 result in flight characteristics that provide the same or reduced drag profile relative to an arrow equipped with a conventional arrowpoint. In accordance with one embodiment, the maximum diameter E is substantially equal to the maximum diameter D. In accordance with this embodiment, the construction of the arrowpoint 30 results in the flight characteristics (including arrow drag) of an arrow equipped with the arrowpoint 30 substantially matching the flight characteristics of an arrow equipped with a conventional arrowpoint because the weight, center of mass and drag profile of the arrowpoint 30 substantially match the same characteristics of the conventional arrowpoint.

Although described as a component included as part of the arrowpoint, the insert, extension and tail can be provided independent of the arrowpoint in accordance with various embodiments. Further, although described as an arrowpoint 30, features of the electronic apparatus described herein can be attached to or included as part of a nock located at the rear of the arrow, or an insert to which a conventional arrowpoint attaches. For example, an electronic apparatus including the body 32 and fitting 44 as described herein can be configured to attach to the nock or at the rear of the insert so that the electronic apparatus is located inside the arrow shaft when the arrow is shot. According to these embodiments, an insert 36, an extension 38 and tail 40 need not be employed with the electronic apparatus.

In addition, although primarily described in an embodiment of the arrowpoint 30 including the insert 36, it should be apparent from the disclosure herein that further embodiments can provide an electronic apparatus suitable for direct attachment to a conventional arrow insert in the manner of a conventional arrowpoint. According to these embodiments, the arrowpoint includes the body 32, the rear fitting 33, electronics and power source housed within the body, and a nose but does not include the insert 36, the extension 38 or the tail 40. In these embodiments, the rear fitting 33 has threads suitable for attaching to the threads of a conventional insert.

The electronics included in the body 32 are not restricted to any particular type of electrical, electronic or sensing equipment. Further, the compact construction and durability of the electronic package also make it suitable for any other application in which a small form factor and rugged electronic system are desirable, for example, in further sensor applications. Also, the ability to temporarily remove the fitting 44 is quite useful where access to the power source or other electronic or electrical components located in the body 32 is desired. According to further embodiments, an electronic apparatus including the body 32 and fitting 44 as described herein can be configured to locate in or on an object (animate or inanimate). According to these embodiments, an insert 36, an extension 38 and tail 40 need not be employed with the electronic apparatus.

Although the embodiments described herein refer to a power source that includes the battery pack 42, other forms of power source can be employed in further embodiments. For example, a single battery can be employed, different styles and/or types of battery power source can be employed (including rechargeable batteries and/or flat lithium ion batteries) and non-battery power sources can be employed (for example, a capacitor or super capacitor). In addition, the power source can be secured to a contact pad or otherwise attached to the PCB.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An electronic apparatus configured for inclusion in an arrow when shot from a bow, the electronic apparatus comprising:

a tubular body providing a cylindrical wall having a smooth interior surface and including a first end and a second end located opposite the first end;

a first fitting configured to secure at least partly within the first end;

a second fitting configured to secure at least partly within the second end; and a circuit board located at least partly within the tubular body, wherein each of the first fitting and the second fitting are secured by attachment to respective regions of the smooth interior surface.

2. The electronic apparatus of claim 1, wherein the tubular body includes a drawn tubular body selected from a group consisting of a seamless tubular body and a welded tubular body.

3. The electronic apparatus of claim 1, wherein the tubular body includes a drawn tubular body selected from a group consisting of a rod drawn tubular body, a floating plug drawn tubular body, a tethered plug drawn tubular body and a fixed plug drawn tubular body.

4. The electronic apparatus of claim 1, wherein the electronic apparatus is included in an arrowpoint.

5. The electronic apparatus of claim 4, wherein the tubular body is configured as a body of the arrowpoint.

6. The electronic apparatus of claim 1, wherein the tubular body is configured for attachment to a nock.

7. The electronic apparatus of claim 1, wherein the arrow includes an arrow shaft, and wherein the tubular body is sized and configured to fit within the arrow shaft.

8. The electronic apparatus of claim 1, wherein the tubular body includes a conductive tubular body.

9. The electronic apparatus of claim 1, wherein at least one of the first fitting and the second fitting are secured by attachment to the cylindrical wall with an interference fit.

10. The electronic apparatus of claim 9, wherein each of the first fitting and the second fitting are secured by attachment to the cylindrical wall with a respective interference fit.

11. An electronic apparatus comprising:

a tubular body;

a fitting having a rim and a plurality of moveable regions fixedly attached at and extending from the rim, the moveable regions configured for insertion within the tubular body and providing an adjustable outside diameter, the moveable regions employed to increase the outside diameter to secure at least a portion of the fitting within the tubular body; and electronic circuitry located within the tubular body.

12. The electronic apparatus of claim 11, further comprising a screw configured to thread into the fitting to adjust the outside diameter.

13. The electronic apparatus of claim 11, wherein the tubular body is electrically conductive.

14. The electronic apparatus of claim 13, wherein the fitting is electrically conductive and is configured to complete an electrical contact with the tubular body when secured within the tubular body.

15. The electronic apparatus of claim 14, wherein the electrical contact is connected to the electronic circuitry when the electronic apparatus is assembled.

16. The electronic apparatus of claim 14, wherein the electrical connection is a first electrical connection, wherein the electronic apparatus further comprises at least one battery configured for inclusion in the tubular body, and wherein the fitting is configured to complete a second electrical connection with the at least one battery.

17. The electronic apparatus of claim 11, wherein the electronic apparatus is configured for inclusion in an arrowpoint.

18. The electronic apparatus of claim 11, further comprising a rear fitting configured to couple the tubular body to the arrow.

19. The electronic apparatus of claim 11, wherein each of the moveable regions includes a distal end separated from one or more adjacent moveable regions included in the plurality of moveable regions by a gap.

20. An electrically conductive fitting configured for use in a circuit employed by an electronic apparatus at least partly located in a housing, the electrically conductive fitting comprising:

a body including a set of threads configured to receive a screw;

a movable portion coupled to the body and configured to move outward to expand an outside diameter of a region of the electrically conductive fitting by adjustment of the screw when received by the body; and a conductive surface configured to provide an electrical contact used in the circuit, wherein the movable portion is configured to engage a conductive surface of the housing.

21. The electrically conductive fitting of claim 20, further comprising at least one tab extending from the body, the tab configured to engage a corresponding feature of the housing to fix a rotational position of the electrically conductive fitting when installed in the housing.

22. The electrically conductive fitting of claim 21, wherein the body is configured to be located in a fixed axial position in the housing by operation of the screw to expand the movable region.

23. The electrically conductive fitting of claim 20, wherein the conductive surface of the fitting is included in the movable portion.

24. An electronic arrowpoint for use with an arrow including an arrowshaft, the arrowpoint comprising:

a body configured to house an electronic apparatus;

a shaft coupled to the body and configured to attach the electronic arrowpoint to the arrow, the shaft including:

a tube having a first open end and a second open end, the first open end configured to be coupled to a rear of the body; and a solid weight configured to at least partially insert within the second open end; and an insert coupled to the shaft, wherein the first open end is configured to couple to the rear of the body via the insert, wherein the tube and the solid weight are configured to locate within the arrowshaft with the solid weight at least partially inserted within the second open end.

25. The electronic arrowpoint of claim 24, wherein the tube includes a length, wherein the solid-weight includes an axial location when at least partially inserted within the second open end of the tube having the length, and a mass, and wherein the length, the mass and the axial location are selected to provide a center of mass for the fully assembled electronic arrowpoint at a location that substantially matches a location of a center of mass of a conventional arrowpoint.

26. The electronic arrowpoint of claim 24, wherein the solid weight includes a break-off weight.

* * * * *